US012654807B2

(12) United States Patent
Sun et al.

(10) Patent No.: US 12,654,807 B2
(45) Date of Patent: Jun. 16, 2026

(54) COMBINED DISC-TYPE CAVITATION STRUCTURE FOR UNDERWATER NAVIGATION OF UNDERWATER VEHICLE

(71) Applicant: DALIAN UNIVERSITY OF TECHNOLOGY, Dalian (CN)

(72) Inventors: Tiezhi Sun, Dalian (CN); Yao Li, Dalian (CN); Zhi Zong, Dalian (CN); Bohan Xie, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 402 days.

(21) Appl. No.: 18/552,022

(22) PCT Filed: Oct. 27, 2022

(86) PCT No.: PCT/CN2022/127980
§ 371 (c)(1),
(2) Date: Sep. 22, 2023

(87) PCT Pub. No.: WO2023/072200
PCT Pub. Date: May 4, 2023

(65) Prior Publication Data

US 2024/0182137 A1 Jun. 6, 2024

(30) Foreign Application Priority Data

Oct. 29, 2021 (CN) ..... 202111275483.2

(51) Int. Cl.
*B63B 1/38* (2006.01)

(52) U.S. Cl.
CPC ..... *B63B 1/38* (2013.01); *B63B 2001/382* (2013.01)

(58) Field of Classification Search
CPC ..... B63B 1/38; B63B 2001/382
See application file for complete search history.

(56) References Cited

U.S. PATENT DOCUMENTS 3,041,992 A * 7/1962 Lee ..... B63G 8/00 114/67 R
5,292,270 A * 3/1994 Tucker ..... F16C 17/14 403/312

(Continued)

FOREIGN PATENT DOCUMENTS

CN 103514309 A 1/2014
CN 110758695 A 2/2020

(Continued)

*Primary Examiner* — Shane Bomar
(74) *Attorney, Agent, or Firm* — NKL Law; Allen Xue

(57) ABSTRACT

A combined disc-type cavitation structure for underwater navigation of an underwater vehicle has an underwater vehicle and a fairing. A plurality of cavitators having sequentially increased outer diameters are sequentially arranged in the fairing. A cavitator receiving groove matched with the cavitator located on the front side is arranged in the center of the front surface of the cavitator located on the rear side in every two adjacent cavitators. The plurality of cavitators can be integrated into a whole by means of the cavitator receiving groove. The cavitator located at the front-most end is a first cavitator, and the remaining cavitators are second cavitators. The first cavitator is connected to the underwater vehicle by means of a buffer. Each second cavitator is respectively connected to the underwater vehicle by means of a driving device configured to axially move the corresponding second cavitator.

9 Claims, 15 Drawing Sheets

(56) References Cited

U.S. PATENT DOCUMENTS

| | | | | |
|---|---|---|---|---|
| 6,216,626 | B1 | 4/2001 | Curtis | |
| 6,684,801 | B1 | 2/2004 | Kuklinski | |
| 7,874,251 | B1 * | 1/2011 | Fu | F42B 10/46 114/20.1 |
| 8,146,501 | B1 | 4/2012 | Fu | |
| 2002/0178990 | A1 * | 12/2002 | McBride | B63G 8/16 114/312 |
| 2019/0322335 | A1 * | 10/2019 | Kim | B63B 1/34 |
| 2024/0034437 | A1 * | 2/2024 | Sun | B63B 1/38 |
| 2024/0149980 | A1 * | 5/2024 | Sun | B63B 1/38 |
| 2024/0246637 | A1 * | 7/2024 | Li | B63B 1/36 |
| 2024/0262481 | A1 * | 8/2024 | Sorkin | B63H 20/34 |

FOREIGN PATENT DOCUMENTS

| | | | |
|---|---|---|---|
| CN | 111332438 | A | 6/2020 |
| CN | 111806174 | A | 10/2020 |
| CN | 111824324 | A | 10/2020 |
| CN | 112413038 | A | 2/2021 |
| CN | 112413040 | A | 2/2021 |
| CN | 112781448 | A | 5/2021 |
| CN | 112985188 | A | 6/2021 |
| CN | 113879451 | A | 1/2022 |

* cited by examiner

COMBINED DISC-TYPE CAVITATION STRUCTURE FOR UNDERWATER NAVIGATION OF UNDERWATER VEHICLE

TECHNICAL FIELD

The present invention relates to the technical field of underwater navigation of an underwater vehicle, in particular to a combined disc-type cavitation structure for underwater navigation of an underwater vehicle.

BACKGROUND

The continuous progress and development of underwater equipment technology makes unmanned underwater vehicles and air-launched underwater weapons increasingly be valued by people. An important issue for air-launched underwater vehicles is that the underwater vehicles, after being launched at a high speed by aerial vehicles, will be subjected to a huge water-entry impact load in a short time upon contact with the water surface, and this overload process has been proved to damage the underwater vehicle structure. In addition, in order to maintain a lower navigation resistance, it is necessary to make supercavity navigation as far as possible after the underwater vehicle enters the water. Therefore, the front section of an underwater vehicle generally needs to be installed with a cavitator. When the underwater vehicle is faced with complex water environments and the subsequent underpowered case, the cavitation effect of traditional cavitators is limited and will also be weakened in the process of the gradual attenuation of the power of the underwater vehicle. The size of the existing cavitators cannot be adjusted according to the navigation speed of the underwater vehicle. The supercavity generated by the cavitator with a too small size is also small, the structure of the underwater vehicle cannot be completely wrapped by the supercavity, underwater navigation resistance of the underwater vehicle will change from air resistance to water resistance, which greatly increases the resistance and further reduces the voyage. However, the resistance generated by the cavitator with a too large size will also be greatly increased.

SUMMARY OF THE INVENTION

According to the above technical problems, the present invention provides a combined disc-type cavitation structure for underwater navigation of an underwater vehicle. The present invention adopts a plurality of cavitators in turn arranged front and back, and can adjust the position of each cavitator according to needs, thereby generating supercavity suitable for the navigation speed of the underwater vehicle.

Technical solutions adopted by the present invention are as follows:

A combined disc-type cavitation structure for underwater navigation of an underwater vehicle includes an underwater vehicle with a front end thereof separably connected with a fairing disposed coaxially with the underwater vehicle. A plurality of cavitators with successively increasing outer diameters is in turn arranged inside the fairing from a front end to a rear end of the fairing. The cavitators are arranged coaxially and the axes thereof coincide with an axis of the underwater vehicle.

A cavitator receiving groove, matching a cavitaor located at a front side in every two adjacent cavitators, is disposed at a center of a front surface of a cavitator located at a rear side in every two adjacent cavitators. The plurality of cavitators can be integrated into a whole through the cavitator receiving groove.

The front-most cavitator is a first cavitator and all the cavitators behind the first cavitator are the second cavitators. There is a cavity between the first cavitator and the head of the fairing. The first cavitator is connected to the underwater vehicle through a buffer configured to buffer the acting force between the underwater vehicle and water when the underwater vehicle enters the water. Each of the second cavitators is connected to the underwater vehicle through a driving device configured to axially move its corresponding second cavicator. The supercavity generated by the first cavitator can completely wrap the underwater vehicle.

The fairing is separated from the underwater vehicle after the underwater vehicle enters water. During the separation process and after that, the buffer buffers and unloads the load during the water-entry process. The size of the generated supercavity can be selected according to the navigation speed of the underwater vehicle, and the position of the second cavitator can be adjusted according to demands by using the driving device. For example, when a slightly larger cavitator is needed, the front-most second cavitator can be moved forward to enable the first cavitator to enter the cavitator receiving groove of the front-most second cavitator, so that the first cavitator and the front-most second cavitator form a whole which is used to generate a required supercavity.

Preferably, the fairing includes a cone section and a cylinder section, the cone section is located at a front end of the cylinder section, and a rear end of the cylinder section is connected to the underwater vehicle through a de-energized electromagnet disposed in the underwater vehicle. The fairing is composed of a plurality of split housings, and the every two adjacent split housings are connected through a connection structure. A blasting device is disposed at the connection structure, and a detonating device is disposed in the underwater vehicle for detonating the blasting device. After the detonating device detonates the blasting device, the fairing is separated along the connection structures between adjacent split housings. The cone section is configured to reduce the contact area between the fairing and water, and the cylinder section is configured to place a plurality of cavitators inside. In order to have better buffering effect, the outer edge of each cavitator can be in contact connection with the cone section.

An output end of the buffer passes through all the second cavitators and is fixedly connected to the first cavitator, and the output end of the buffer is in clearance fit with each the second cavitator. The buffer includes an outer sleeve, an inner sleeve is disposed in the outer sleeve, a part between the outer sleeve and the inner sleeve forms an oil storage cavity. A first piston rod is disposed in the inner sleeve, a front end of the first piston rod passes through the outer sleeve and the inner sleeve, and is fixedly connected to the first cavitator. A first piston is disposed at rear end of the first piston rod, and a part between the first piston and a front end of the inner sleeve is provided with a tension spring sleeved on the first piston rod. A damper base is fixed at a head end of the underwater vehicle, and a rear end of the outer sleeve is fixedly connected to the damper base.

A front end of the first cavitator is provided with a blowback system for blowing gas forward.

The blowback system includes a first vent tube. A front end of the first vent tube successively passes through a rear center of the outer sleeve and a rear end center of the inner sleeve, penetrates into the first piston rod and is in airtight sliding connection with an inner wall of the first piston rod. An inside of the first piston rod close to its front end is provided with a buffer gas cavity, a rear end of the buffer gas cavity is communicated with the front end of the first vent tube. The buffer gas cavity is internally provided with a first compression spring with an axis coinciding with an axis of the first piston rod. An end surface of the first vent tube abuts against the first compression spring. A front end of the first piston rod is provided with a through hole communicated with the buffer gas cavity, and a front end of the through hole is communicated with a gas collection cavity disposed in the first cavitator. A first gas path is disposed in the damper base, a front end of the first gas path is communicated with a rear end of the first vent tube, and a first ventilation valve is disposed in the first gas path. A gas storage tank is disposed in the underwater vehicle, a gas outlet of the gas storage tank is communicated with a rear end of the first gas path. The front end of the first cavitator is provided with a jet port which is provided with a reverse jet valve inside. By disposing the reverse jet valve and the gas collection cavity, the first vent tube, the first ventilation valve and the gas storage tank, the high-pressure gas in the gas storage tank can be jetted from the reverse jet valve, thereby further buffering the acting force of water, and meanwhile it can be more conducive to form supercavity.

At least one slider mechanism is disposed at an outer edge of the first cavitator, and the cavitator receiving groove of the second cavitator close to the first cavitator is provided with a slot matching the slider mechanism. The slider mechanism includes a slider and a slider driving mechanism that drives the slider to slide in a radial direction of the first cavitator. When the first cavitator is located in the cavitator receiving groove, the slot seizes the slider.

Except the second cavitator at the rearmost end, the outer edges of all the other second cavitators and the outer edge of the first cavitator are oblique planes. The slider driving mechanism includes a sliding slot machined on a side wall of the first cavitator, and the slider is in sliding fit with the sliding slot. A bottom of the slider and a bottom of the sliding slot are connected with a fixed pin compression spring. A limiting stop is disposed on a wall of the sliding slot, a limiting slot is machined on a side of the slider facing the limiting stop, and the limiting stop is located in the limiting slot. A slider driving gas cavity is formed among a lower side of the limiting stop, the limiting slot and the wall of the sliding slot. One end of a second vent tube is communicated with the gas collection cavity through a slider driving air valve, and the other end of the second vent tube radially penetrates into the first cavitator and penetrates out of the slider driving gas cavity. Since the underwater vehicle may be inclined into water during the water entry process, in the case of inclined water entry, the cavitator with a larger outer diameter may be offset by a certain axis under the action of force. Using an oblique plane makes it easier to combine with the rear end of the cavitator with a smaller outer diameter and an un-offset axis when the cavtator with a larger outer diameter moves forward. At the same time, the use of oblique plane can form a wedge-shaped structure, which is easy for the slider to slide into the sliding slot. The outer diameter of the rear end of the first and second cavitators is smaller than that of the front end thereof. According to the design of the oblique plane, when the first cavitator moves to the second cavitator, the two oblique planes matching with each other will compress the slider to move towards the bottom of the sliding slot until the slider enters the slot disposed in the cavitator receiving groove. At this time, the slider is no longer under pressure and moves again towards the notch the sliding slot under the action of the fixed pin compression spring, and then the slider is seized into the slot disposed in the cavitator receiving groove. When it is necessary to separate the first cavitator from the second cavitator, open the first ventilation valve and the slider driving air valve, so that the high-pressure gas in the gas storage tank enters the slider driving gas cavity, thereby driving the slider to move towards the bottom of the sliding slot, thus the slot disposed in the cavitator receiving groove no longer seizes the slider.

The driving device includes a plurality of pneumatic driving devices which are evenly distributed around an axis of the second cavitators, and an axis of each pneumatic driving device is parallel to the axis of the second cavitators. An output end each pneumatic driving device is hinged with the second cavitator and a hinge point thereof is close to an outer edge of the second cavitator. An output end of each pneumatic driving device hinged with the second cavitator located in front passes through all of the second cavitators located behind this second cavitator and is in clearance with the same. A mounting end of each pneumatic driving device is fixedly connected with the damper base.

Each the pneumatic driving device includes an air cylinder. A second piston rod matching the air cylinder is disposed in the air cylinder. A front end of the second piston rod penetrates out of the air cylinder and is hinged with the second cavitator, and a second piston is fixed at a rear end of the second piston rod. A part between a front end of the air cylinder and the second piston is provided with a second compression spring sleeved on the second piston rod. The damper base is provided with a second gas path inside. One end of the second gas path is communicated with the gas storage tank, and the other end of the second gas path is communicated with a rear end of the air cylinder. The second gas path is provided with a second ventilation valve. The rear end of the air cylinder is provided with an air release valve.

Compared with the prior art, the present invention has the following advantages:

1. The present invention can adjust the position of corresponding cavitator according to the navigation speed of the underwater vehicle, so as to combine two or more cavitators to form supercavity matching the navigation speed of the underwater vehicle. The present invention is applicable to working conditions of a water-entry impact and underwater navigation of the underwater vehicle under a water-entry speed range of 20 m/s-100 m/s.
2. An reverse jet valve is disposed at the front end of the first cavitator, which can generate a reaction force to buffer the underwater vehicle and is conducive to form supercavity at the same time.
3. The present invention adopts a buffer, having good buffering effect.
4. The present invention reasonably utilizes the gas storage tank in the underwater vehicle. The gas in the gas storage tank can not only be used for blowing forward to reduce load, but also be conducive to the generation of supercavity. Meanwhile, the gas in the gas storage tank can also adjust the axial position of the second cavitator, and has a certain load reduction effect when the gas is inflated to the second cavitator. At the same time, the gas in the gas storage tank can also control the contraction of the slider.

Based on the above reasons, the present invention can be widely popularized in the field of water-entry of underwater vehicle.

DETAILED DESCRIPTION OF DRAWINGS

In order to more clearly illustrate the technical solution in the embodiments of the present invention or in the prior art, the accompanying drawings required to be used in the description of the embodiments or the prior art are briefly introduced. Obviously, the accompanying drawings in the description below are some embodiments of the present invention. For those ordinary skilled in the art, other accompanying drawings can be obtained from these accompanying drawings without creative labor.

Figure 1:
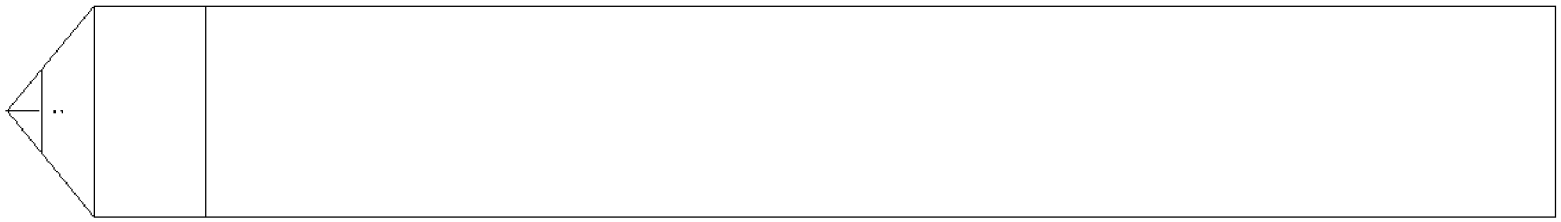
FIG. 1 is a front view of a combined disc-type cavitation structure for underwater navigation of an underwater vehicle in an embodiment of the present invention.
Figure 2:
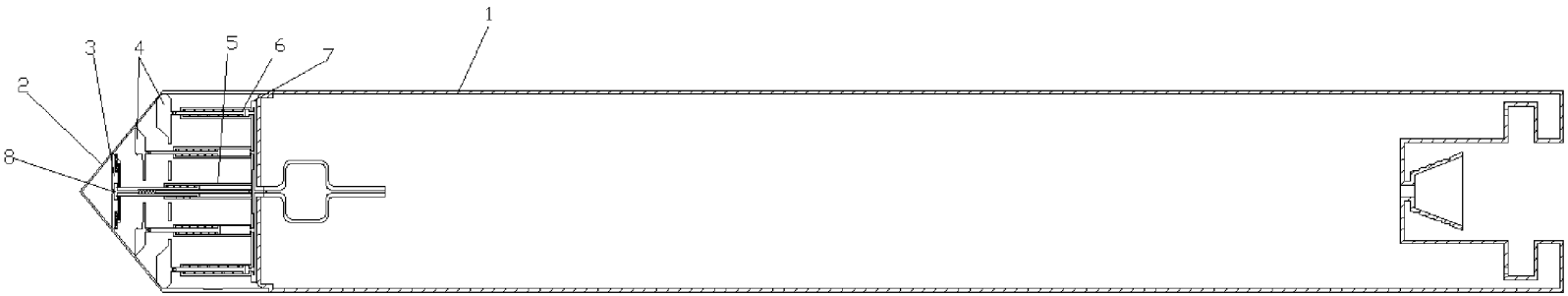
FIG. 2 is a section view (overall) of a combined disc-type cavitation structure for underwater navigation of an underwater vehicle in an embodiment of the present invention.
Figure 3:
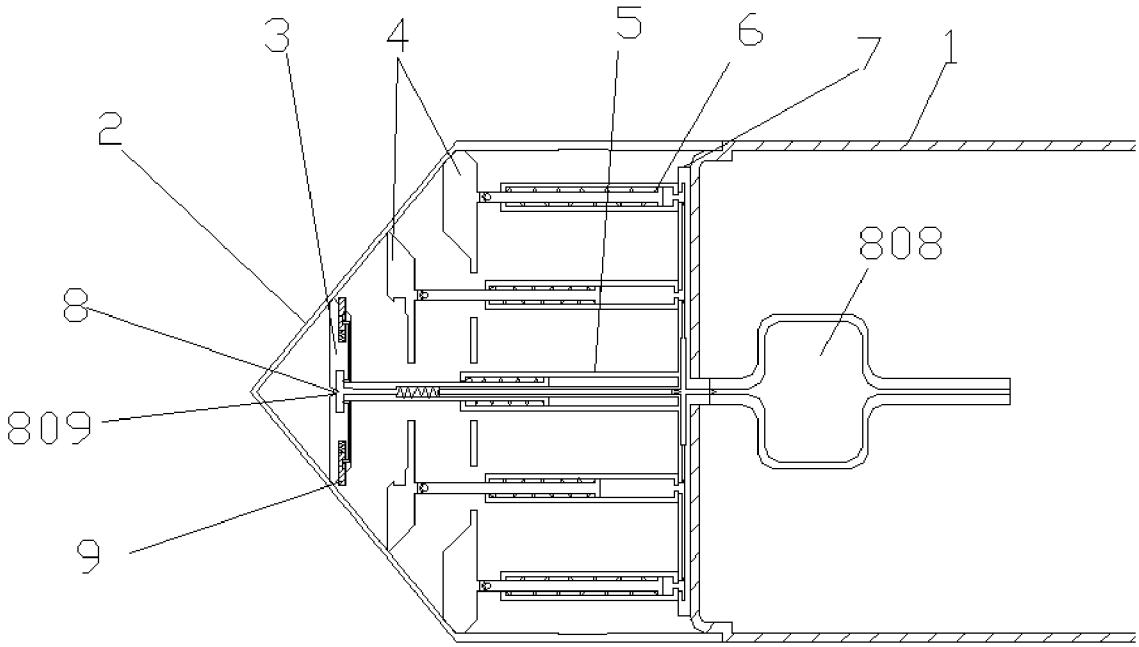
FIG. 3 is a section view (front end) of a combined disc-type cavitation structure for underwater navigation of an underwater vehicle in an embodiment of the present invention.
Figure 4:
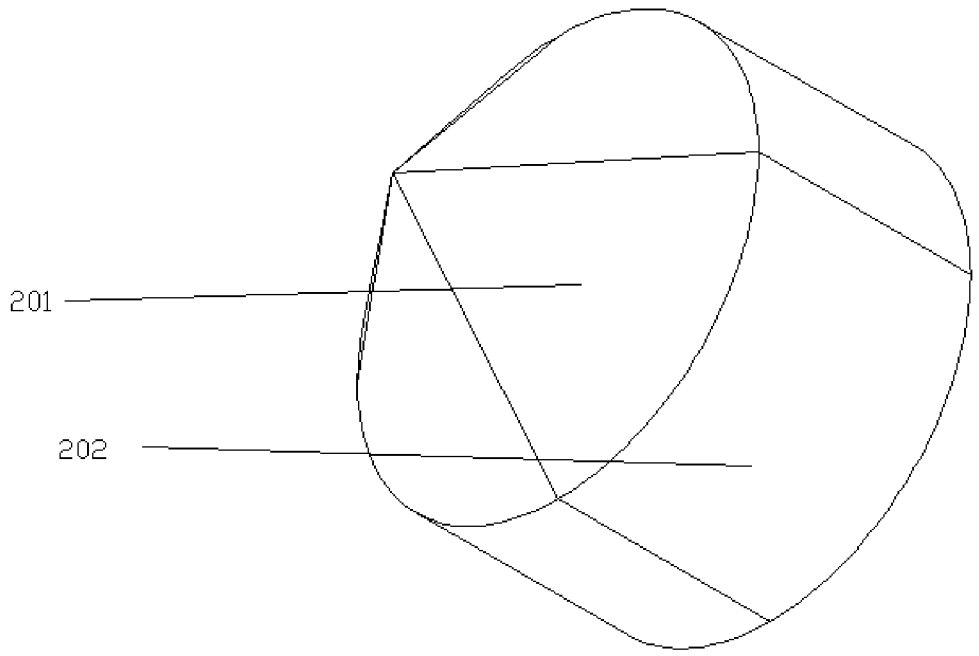
FIG. 4 is a structure schematic diagram of a fairing in an embodiment of the present invention.
Figure 5:
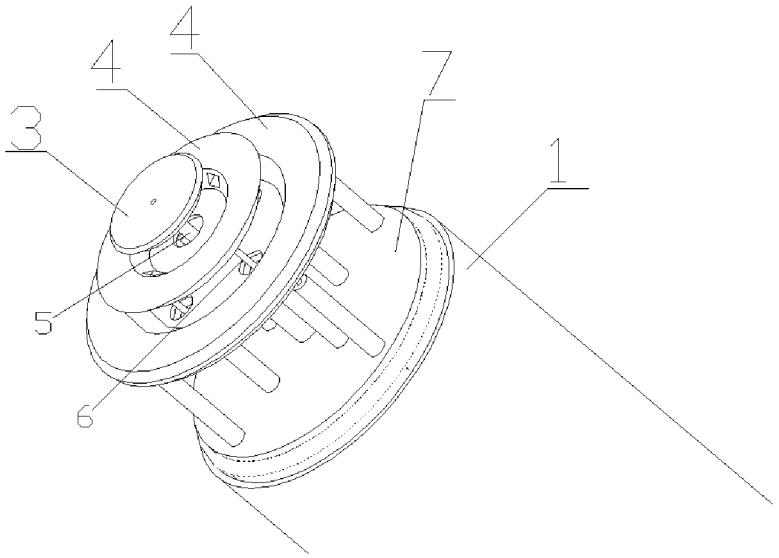
FIG. 5 is a three-dimensional view of a combined disc-type cavitation structure for underwater navigation of an underwater vehicle (without the fairing) in an embodiment of the present invention.
Figure 6:
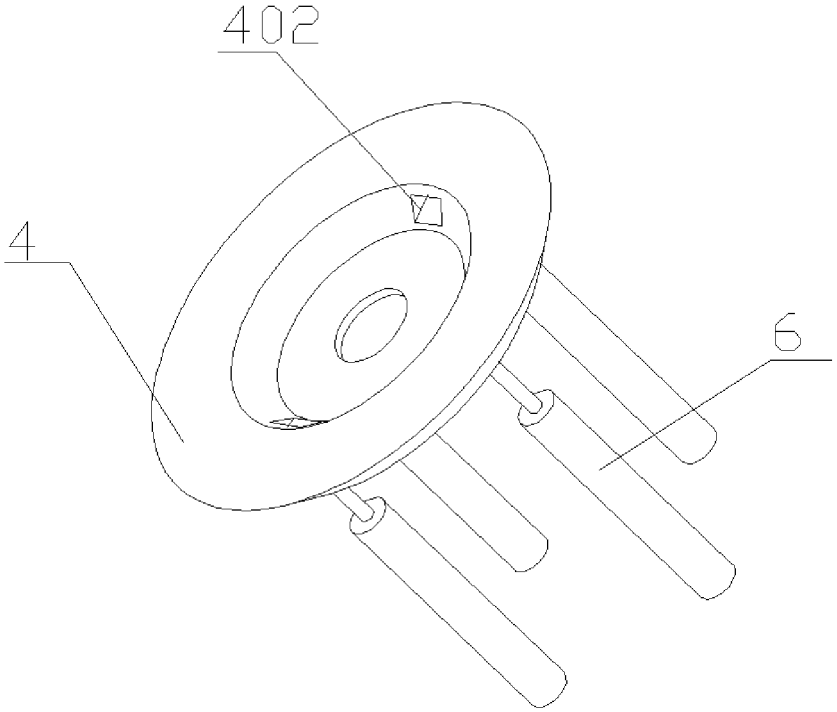
FIG. 6 is a schematic diagram of the front-most second cavitator in an embodiment of the present invention.
Figure 7:
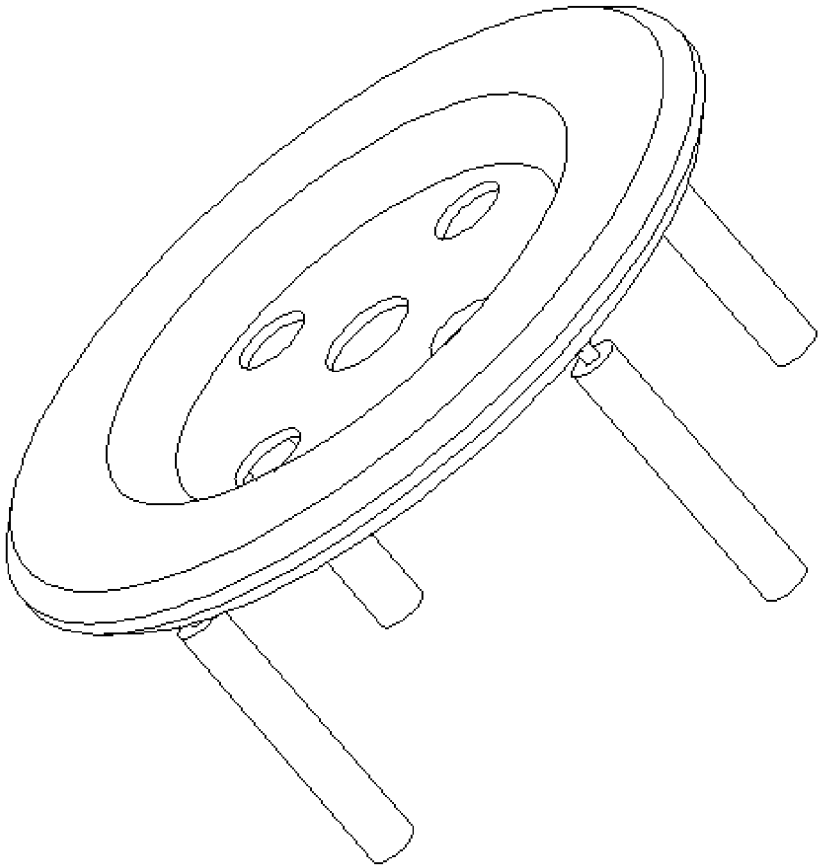
FIG. 7 is a schematic diagram of the secondary second cavitator in the embodiment of the present invention.
Figure 8:
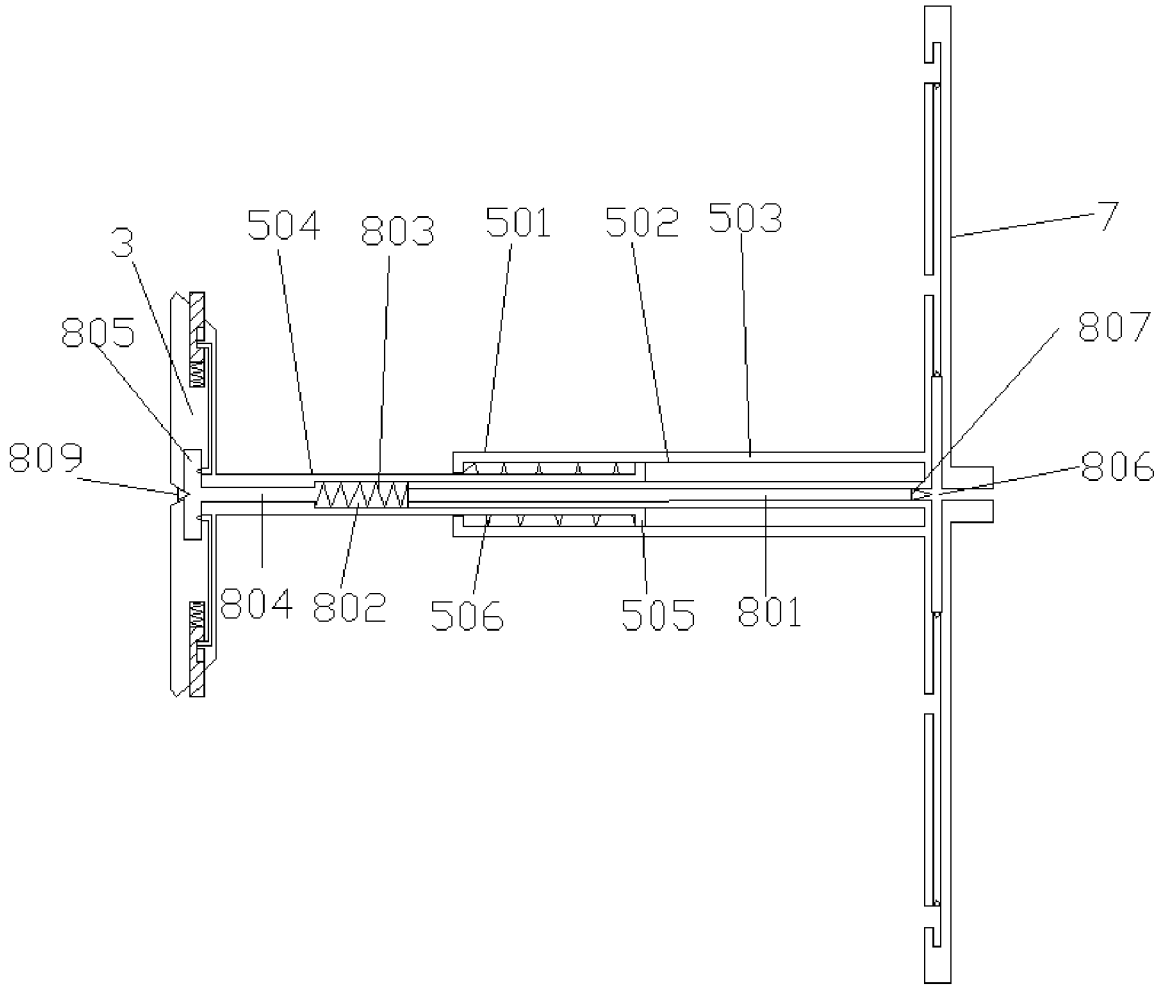
FIG. 8 is a section view of a buffer in an embodiment of the present invention.

In the figures: 1—underwater vehicle, 2—fairing, 201—cone section, 202—cylinder section, 3—first cavitator, 4—second cavitator, 401—cavitator receiving groove, 402—slot, 5—buffer, 501—outer sleeve, 502—inner sleeve, 503—oil storage cavity, 504—first piston rod, 505—first piston, 506—tension spring, 6—pneumatic driving device, 601—air cylinder, 602—second piston rod, 603—second piston, 604—second gas path, 605—second ventilation valve, 606—second compression spring, 7—damper base, 8—blowback system, 801—first vent tube, 802—buffer gas cavity, 803—first compression spring, 804—through hole, 805—gas collection cavity, 806—first gas path, 807—first ventilation valve, 808—gas storage tank, 809—reverse jet valve, 9—slider mechanism, 901—slider, 902—fixed pin compression spring, 903—limiting stop, 904—limiting slot, 905—second vent tube, 906—slider driving air valve.

DETAILED DESCRIPTION OF PREFERRED EMBODIMENTS

It should be noted that, in the case of no conflicts, the embodiments and the features in the embodiments of the present invention can be combined mutually. The present invention will be described in detail below with reference to the accompanying drawings and the embodiments.

To make the objectives, technical solutions, and advantages of the present invention clearer, the following clearly and completely describes the technical solutions in the embodiments of the present invention with reference to the accompanying drawings in the embodiments of the present invention. Apparently, the described embodiments are merely some rather than all of the embodiments. The following description of at least one exemplary embodiment is actually only illustrative, and in no way serves as any limitation on the present invention and its application or use. Based on the embodiments of the present invention, all the other embodiments obtained by those of ordinary skill in the art without creative effort are within the protection scope of the present invention.

It should be noted that the terms used herein are only intended to describe specific embodiments and are not intended to limit the exemplary embodiments of the present invention. As used herein, unless indicated obviously in the context, a singular form is intended to include a plural form. Furthermore, it should be further understood that the terms "include" and/or "comprise" used in this specification specify the presence of features, steps, operations, devices, components and/or of combinations thereof.

Unless specifically stated otherwise, the relative arrangement of components and steps, numerical expressions, and numerical values set forth in these embodiments do not limit the scope of the present invention. In addition, it should be clear that, for ease of description, sizes of the various components shown in the accompanying drawings are not drawn according to actual proportional relationships. Technologies, methods, and devices known to those of ordinary skill in the relevant fields may not be discussed in detail, but where appropriate, the technologies, methods, and devices should be considered as a part of the authorization specification. In all the examples shown and discussed herein, any specific value should be interpreted as merely being exemplary rather than limiting. Therefore, other examples of the exemplary embodiment may have different values. It should be noted that similar reference signs and letters represent similar items in the accompanying drawings below. Therefore, once an item is defined in one accompanying drawing, the item does not need to be further discussed in a subsequent accompanying drawing.

In the description of the present invention, it should be noted that orientations or position relationships indicated by orientation terms "front, rear, upper, lower, left, and right", "transverse, vertical, perpendicular, and horizontal", "top and bottom", and the like are usually based on orientations or position relationships shown in the accompanying drawings, and these terms are only used to facilitate description of the present invention and simplification of the description. In the absence of description to the contrary, these orientation terms do not indicate or imply that the apparatus or element referred to must have a specific orientation or be constructed and operated in a specific orientation, and therefore cannot be understood as a limitation on the protection scope of the present invention: orientation words "inner and outer" refer to the inside and outside relative to the contour of each component.

For ease of description, spatially relative terms such as "on", "over", "on the upper surface", and "above" can be used here, to describe a spatial positional relationship between one device or feature and another device or feature shown in the figures. It should be understood that the spatially relative terms are intended to include different orientations in use or operation other than the orientation of the device described in the figure. For example, if the device in the figure is inverted, the device described as "above another device or structure" or "on another device or structure" is then be positioned as being "below another device or structure" or "beneath a device or structure". Therefore, the exemplary term "above" can include both orientations "above" and "below". The device can also be positioned in other different ways (rotating by 90 degrees or in another orientation), and the spatially relative description used herein is explained accordingly.

In addition, it should be noted that using terms such as "first" and "second" to define components is only for the convenience of distinguishing the corresponding components. Unless otherwise stated, the foregoing words have no special meaning and therefore cannot be understood as a limitation on the protection scope of the present invention.

As shown in FIGS. 1 to 17, a combined disc-type cavitation structure for underwater navigation of an underwater vehicle includes an underwater vehicle 1 with a front end thereof separably connected with a fairing 2 disposed coaxially with the underwater vehicle 1. A plurality of cavitators with successively increasing outer diameters are in turn arranged inside the fairing 2 from a front end to a rear end of the fairing 2. The embodiment uses three cavitators. The three cavitators are arranged coaxially and the axes thereof coincide with the axis of the underwater vehicle 1. The front-most cavitator is the first cavitator 3, and both the cavitators behind the first cavitator 3 are the second cavitator 4.

A cavitator receiving groove 401, matching the first cavitaor 3 or the second cavitor 4 located at a front side thereof, is disposed at the center of the front surface of the second cavitator 4. The cavitators can be integrated into a whole through the cavitator receiving groove 401.

There is a cavity between the first cavitator 3 and the head of the fairing 2. The first cavitator 3 is connected to the underwater vehicle 1 through a buffer device 5 configured to buffer the acting force between the underwater vehicle 1 and water when the underwater vehicle 1 enters the water. Each of the second cavitators 4 is respectively connected to the underwater vehicle 1 through a driving device configured to axially move its corresponding second cavicator. The supercavity generated by the first cavitator 3 can completely wrap the underwater vehicle.

After entering water, the underwater vehicle 1 is separated from the fairing 2. During the separation process and after that, the buffer 5 buffers and unloads the load during the water-entry process. The size of the generated supercavity can be selected according to the navigation speed of the underwater vehicle 1, and the position of the second cavitator 4 can be adjusted according to demands by using the driving device. For example, when a slightly larger cavitator is needed, the front-most second cavitator 4 can be moved forward to enable the first cavitator 3 to enter the cavitator receiving groove 401 of the front-most second cavitator 4, so that the first cavitator 3 and the front-most second cavitator 4 form a whole which is used to generate a required supercavity.

The fairing 2 includes a cone section 201 and a cylinder section 202. The cone section 201 is located at a front end of the cylinder section, and a rear end of the cylinder section 202 is connected to the underwater vehicle 1 through a de-energized electromagnet disposed in the underwater vehicle 1. The fairing 2 is composed of a plurality of split housings, and the every two adjacent split housings are connected through a connection structure. A blasting device is disposed at the connection structure, and a detonating device is disposed in the underwater vehicle for detonating the blasting device. After the detonating device detonates the blasting device, the fairing is separated along the connection structures between adjacent split housings. The cone section 201 is configured to reduce the contact area between the fairing 2 and water, and the cylinder section 202 is configured to place a plurality of cavitators inside. In order to have better buffering effect, the outer edge of each cavitator can be in contact connection with the cone section 201.

The connection structure is a weak structure, which can be a strong adhesive to bond the adjacent two split housings together, or can be a thin plate to be fixedly connected to the adjacent two split housings. The connection structure should have a certain strength, which can withstand the air resistance during high-speed flight in the air and maintain air tightness, and will not be deformed or damaged, and meanwhile, the connection structure can be exploded and decomposed by the blasting device disposed inside, so that the fairing 2 made of alloy is separated from the head of the underwater vehicle 1.

The output end of the buffer 5 passes through both the second cavitators 4 and is fixedly connected to the first cavitator 3, and the output end of the buffer 5 is in clearance fit with each the second cavitator 4. The buffer 5 includes an outer sleeve 501, and the outer sleeve 501 is provided with an inner sleeve 502 inside. The part between the outer sleeve 501 and the inner sleeve 502 forms an oil storage cavity 503. The inner sleeve 502 is provided with a first piston rod 504 inside. The front end of the first piston rod 504 passes through the outer sleeve 501 and the inter sleeve 502, and is fixedly connected to the first cavitator 3. The rear end of the first piston rod 504 is provided with a first piston 505. The part between the first piston 504 and the front end of the inner sleeve 502 is provided with a tension spring 506 sleeved on the first piston rod 504. The head end of the underwater vehicle 1 is fixed with a damper base 7, and the rear end of the outer sleeve 501 is fixedly connected to the damper base 7.

The front end of the first cavitator 3 is provided with a blowback system 8 for blowing gas forward.

The blowback system 8 includes a first vent tube 801. The front end of the first vent tube 801 successively passes through the rear end center of the outer sleeve 501 and the rear end center of the inner sleeve 502, and penetrates into the first piston rod 504 and is in airtight sliding connection with the inner wall of the first piston rod 504. The inside of the first piston rod 504 close to its front end is provided with a buffer gas cavity 802. The rear end of the buffer gas cavity 802 is communicated with the front end of the first vent tube 801. The buffer gas cavity 802 is internally provided with a first compression spring 803 with an axis coinciding with the axis of the first piston rod 504. The end surface of the first vent tube 801 abuts against the first compression spring 803. A front end of the first piston rod 504 is provided with a through hole 804 communicated with the buffer gas cavity 802. The front end of the through hole 802 is communicated with a gas collection cavity 805 disposed in the first cavitator 3. The damper base 7 is provided with a first gas path 806 inside. The front end of the first gas path is communicated with the rear end of the first vent tube 801. The first gas path 806 is provided with a first ventilation valve 807 inside. The underwater vehicle 1 is provided with a gas storage tank 808 inside. The gas outlet of the gas storage tank is communicated with the rear end of the first gas path 806. The front end of the first cavitator 3 is provided with a jet port, and the jet port is provided with a reverse jet valve 809 inside. By disposing the reverse jet valve 809 and the gas collection cavity 805, the first vent tube 801, the first ventilation valve and the gas storage tank, the high-pressure gas in the gas storage tank can be jetted from the reverse jet valve 809, thereby further buffering the acting force of water, and meanwhile it can be more conducive to form supercavity.

The outer edge of the first cavitator 3 is provided with at least one slider mechanism 9. The cavitator receiving groove 401 of the second cavitator close to the first cavitator is provided with a slot 402 matching the slider mechanism 9. The slider mechanism 9 includes a slider 901 and a slider driving mechanism that drives the slider 901 to slide in a radial direction of the first cavitator 3. When the first cavitator 3 is located in the cavitator receiving groove 402, the slot 402 seizes the slider 901.

Except the second cavitator 4 at the rearmost end, the outer edges of the other second cavitator 4 and the first cavitator 3 are oblique planes. The slider driving mechanism includes a sliding slot machined on a side wall of the first cavitator 3. The slider 901 is in sliding fit with the sliding slot. The bottom of the slider 9 and the bottom of the sliding slot are connected with a fixed pin compression spring 902. The wall of the sliding slot is provided with a limiting stop 903, a limiting slot 904 is machined on the side of the slider 901 facing the limiting stop 903, and the limiting stop 903 is located in the limiting slot 904. The slider driving gas cavity is formed among the lower side of the limiting stop 903, the limiting slot 904 and the wall of the sliding slot. One end of the second vent tube 905 is communicated with the gas collection cavity 805 through the slider driving air valve 906, and the other end of the second vent tube 905 radially penetrates into the first cavitator 3 and penetrates out of the slider driving gas cavity.

The driving device includes a plurality of pneumatic driving devices 6 which are evenly distributed around the axis of the second cavitator 4, and the axis of each pneumatic driving device is parallel to the axis of the second cavitator 4. The output end of each pneumatic driving device 6 is hinged with the second cavitator 4 through a fixed hinge, and the hinge point is close to the outer edge of the second cavitator 4. The output end of each pneumatic driving device 6 hinged with the second cavitator 4 located in front passes through the second cavitator 4 located behind this second cavitator 4 and is in clearance fit with the same. The mounting end of each pneumatic driving device 6 is fixedly connected to the damper base 7.

Each the pneumatic driving device 6 includes an air cylinder 601 which is inside provided with a second piston rod 602 matching the air cylinder 601. The front end of the second piston rod 602 penetrates out of the air cylinder 601 and is hinged with the second cavitator 4, and the second piston 602 is fixed at the rear end of the second piston rod 603. A part between the front end of the air cylinder 601 and the second piston 602 is provided with a second compression spring 606 sleeved on the second piston rod 602. The damper base 7 is provided with a second gas path 604 inside. One end of the second gas path is communicated with the gas storage tank 808, and the other end of the second gas path is communicated with the rear end of the air cylinder 601. The second gas path 604 is provided with a second ventilation valve 605. The rear end of the air cylinder 601 is provided with an air release valve.

Preferably, the first ventilation valve 807, the reverse jet valve 809, the second ventilation valve 605, the slider driving air valve 906 and the air release valve in the embodiment adopt magnetic valves, and the underwater vehicle 1 is provided with a control terminal inside. The above valves are automatically opened by the underwater vehicle according to the actual situation.

Figure 9:
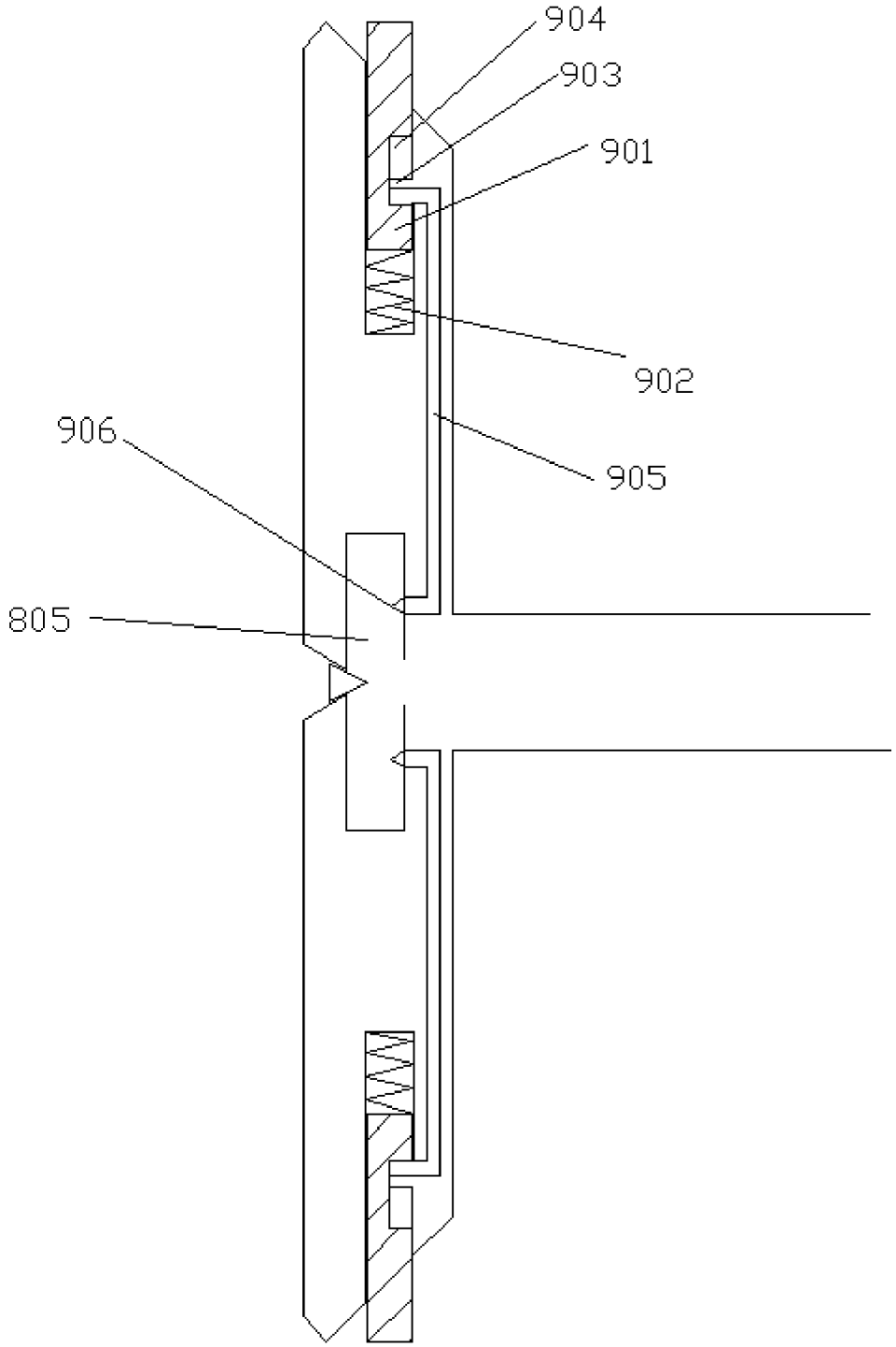
FIG. 9 is a schematic diagram of a slider mechanism in an embodiment of the present invention.
Figure 10:
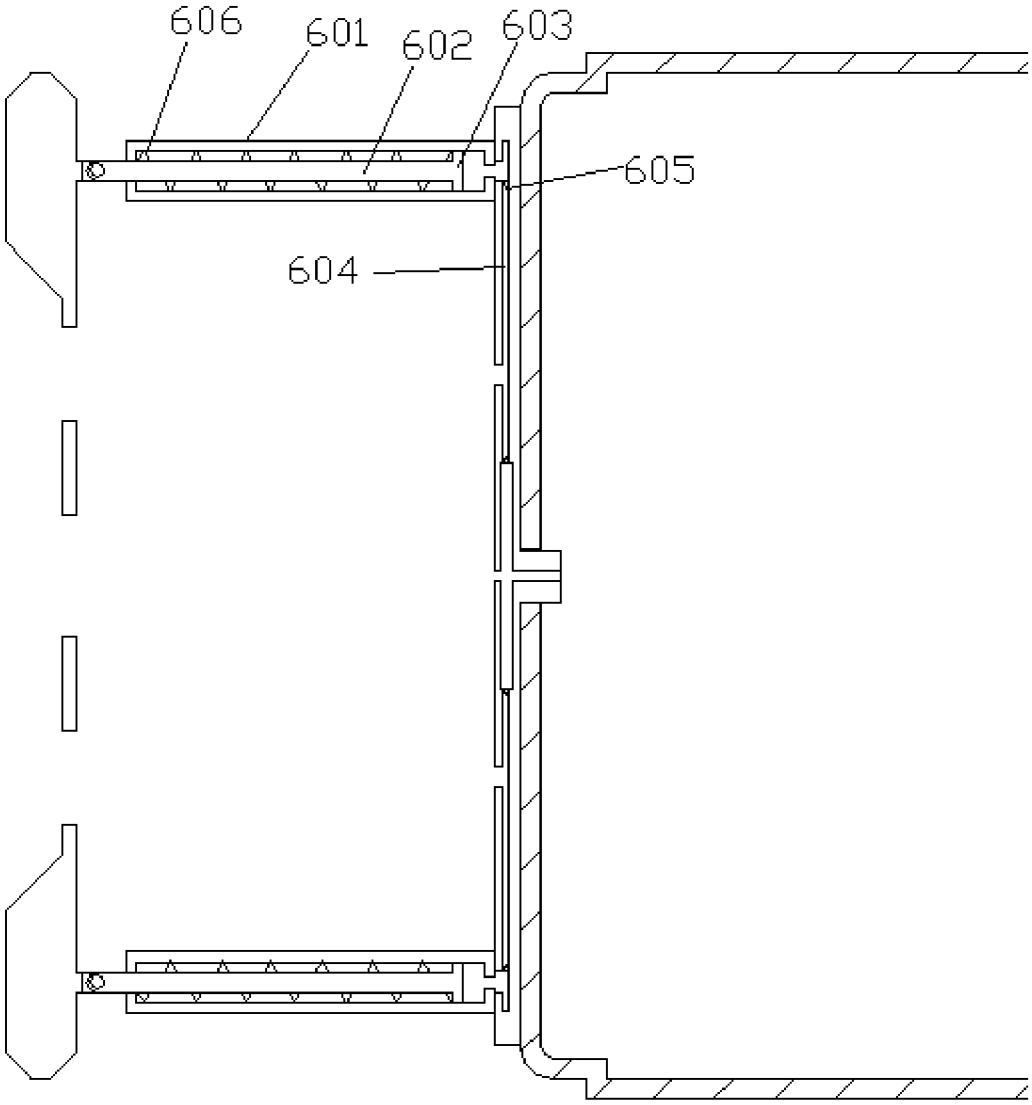
FIG. 10 is a schematic diagram of a pneumatic driving device in an embodiment of the present invention.
Figure 11:
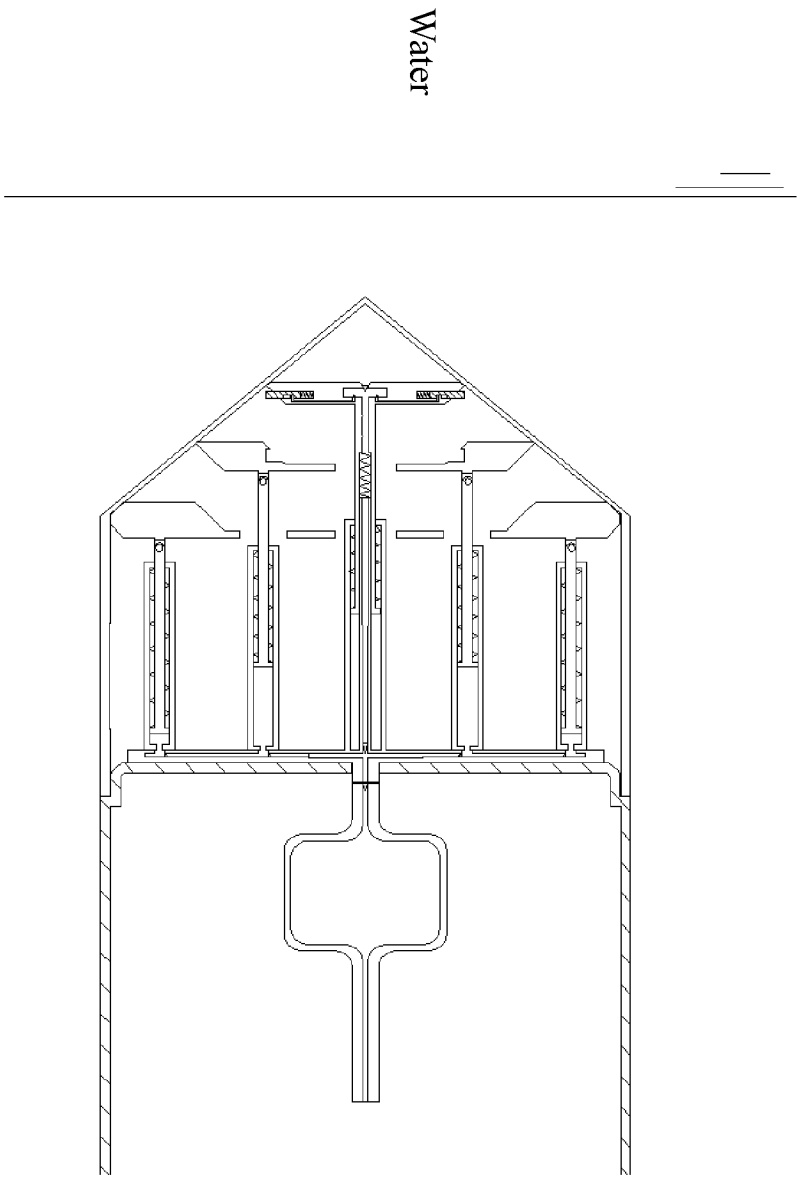
FIG. 11 is a schematic diagram of a combined disc-type cavitation structure for underwater navigation of an underwater vehicle before entering water in an embodiment of the present invention.
Figure 12:
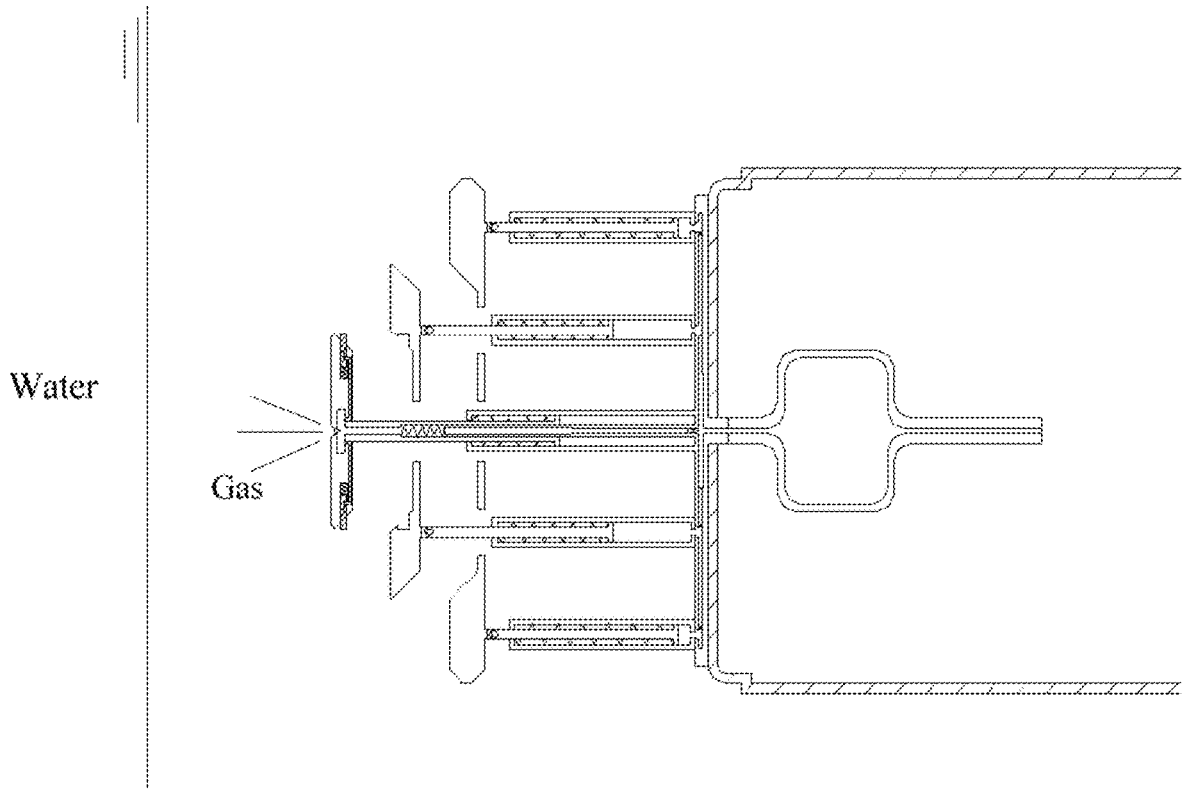
FIG. 12 is a blowing schematic diagram of a blowback system of a combined disc-type cavitation structure for underwater navigation of an underwater vehicle in an embodiment of the present invention, where the underwater vehicle is separated from a fairing before entering water.
Figure 13:
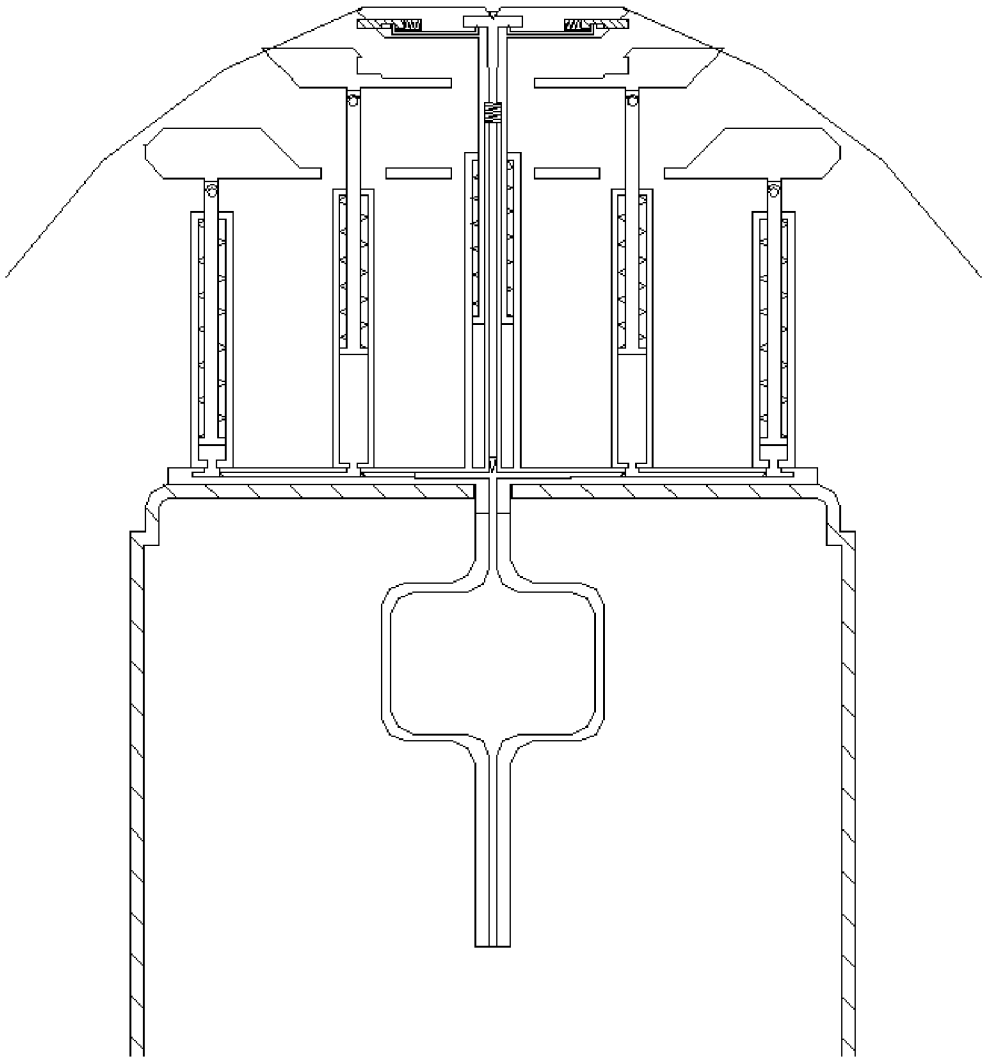
FIG. 13 is a buffering schematic diagram of a buffer after a combined disc-type cavitation structure for underwater navigation of an underwater vehicle enters water in an embodiment of the present invention.
Figure 14:
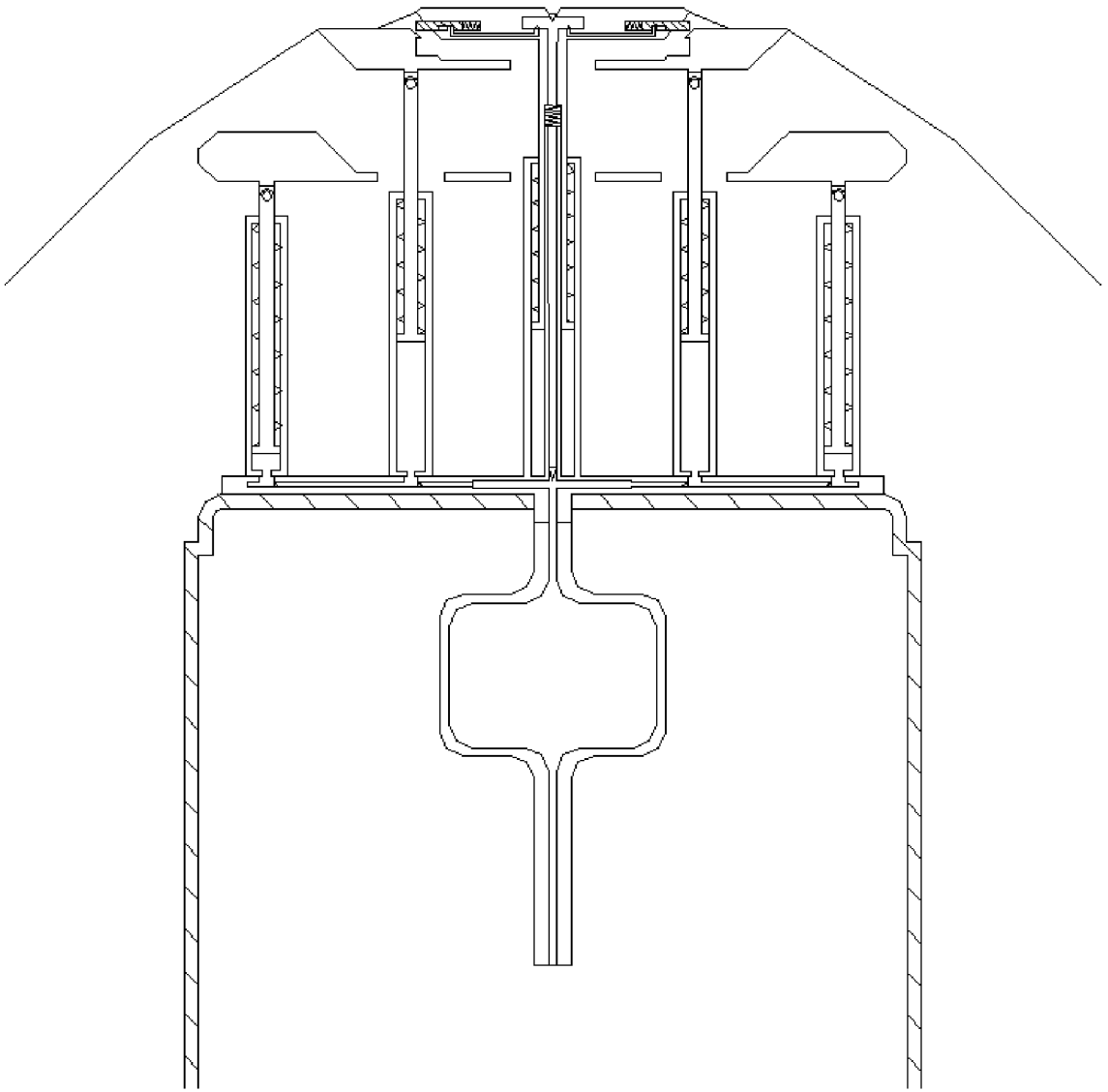
FIG. 14 is a schematic diagram of the front-most second cavitator moving forward after a combined disc-type cavitator for underwater navigation of an underwater vehicle enters water in an embodiment of the present invention.
Figure 15:
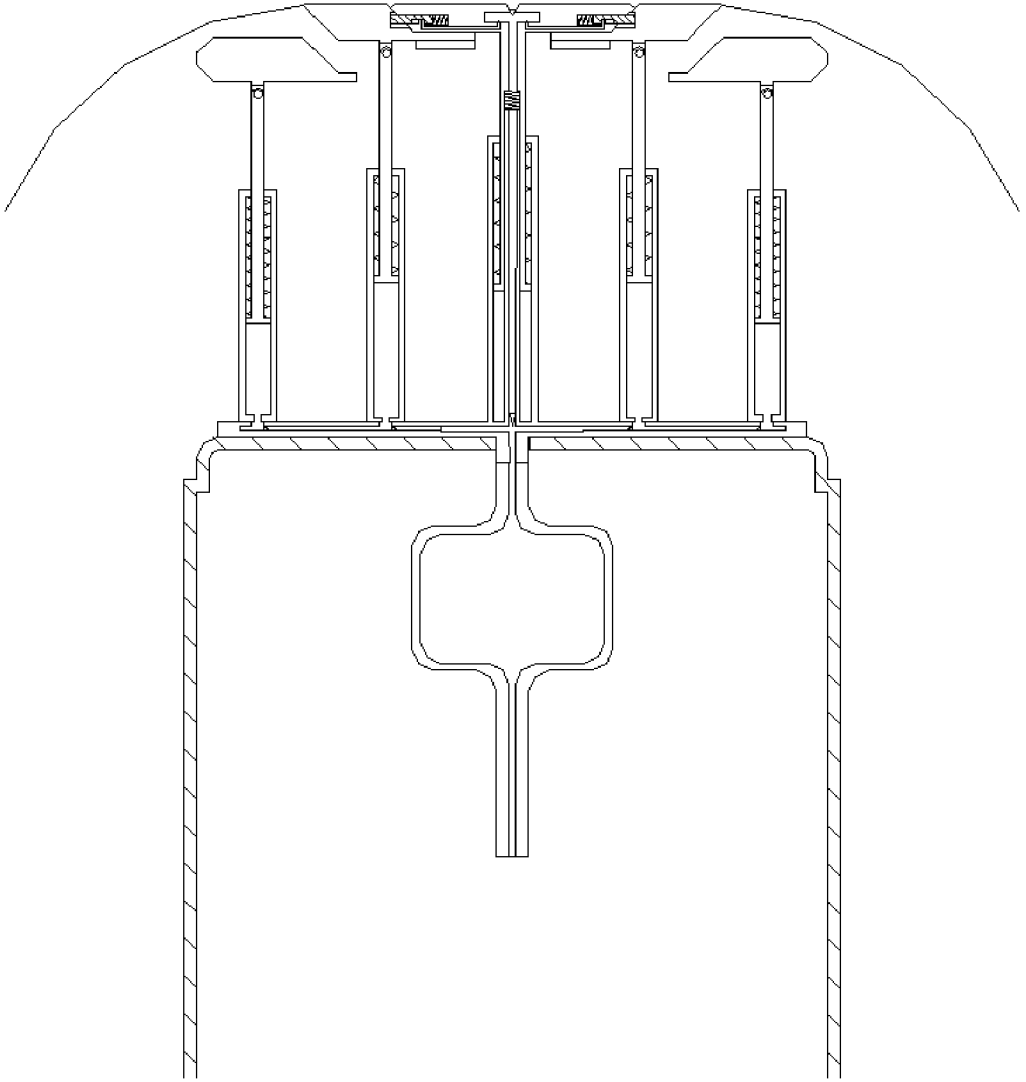
FIG. 15 is a schematic diagram of the front-most second cavitator seizing the first cavitator and the secondary second cavitator moving forward after a combined disc-type cavitator for underwater navigation of an underwater vehicle enters water in an embodiment of the present invention.
Figure 16:
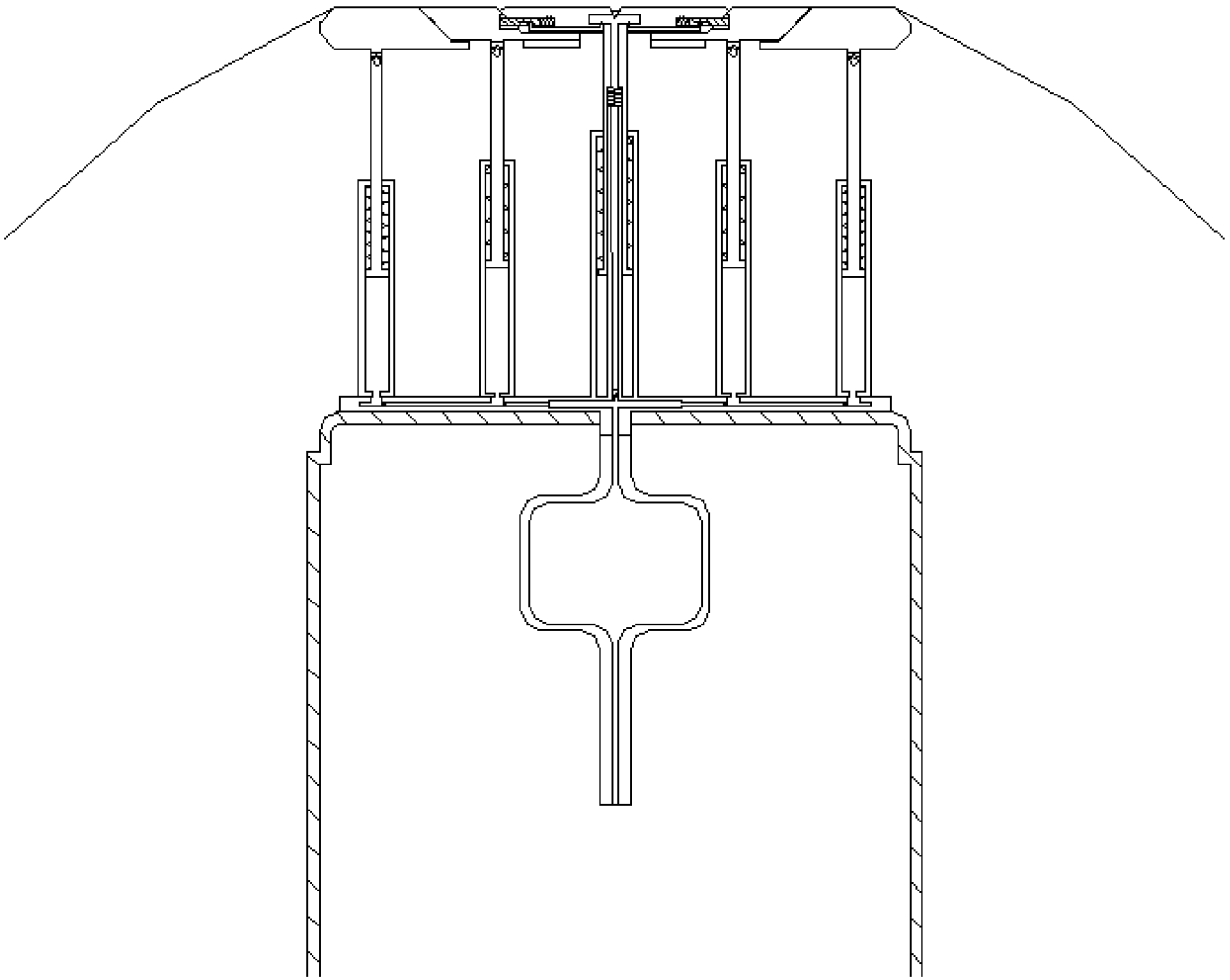
FIG. 16 is a schematic diagram of three cavitators being combined into a whole after a combined disc-type cavitation structure for underwater navigation of an underwater vehicle enters water in an embodiment of the present invention.
Figure 17:
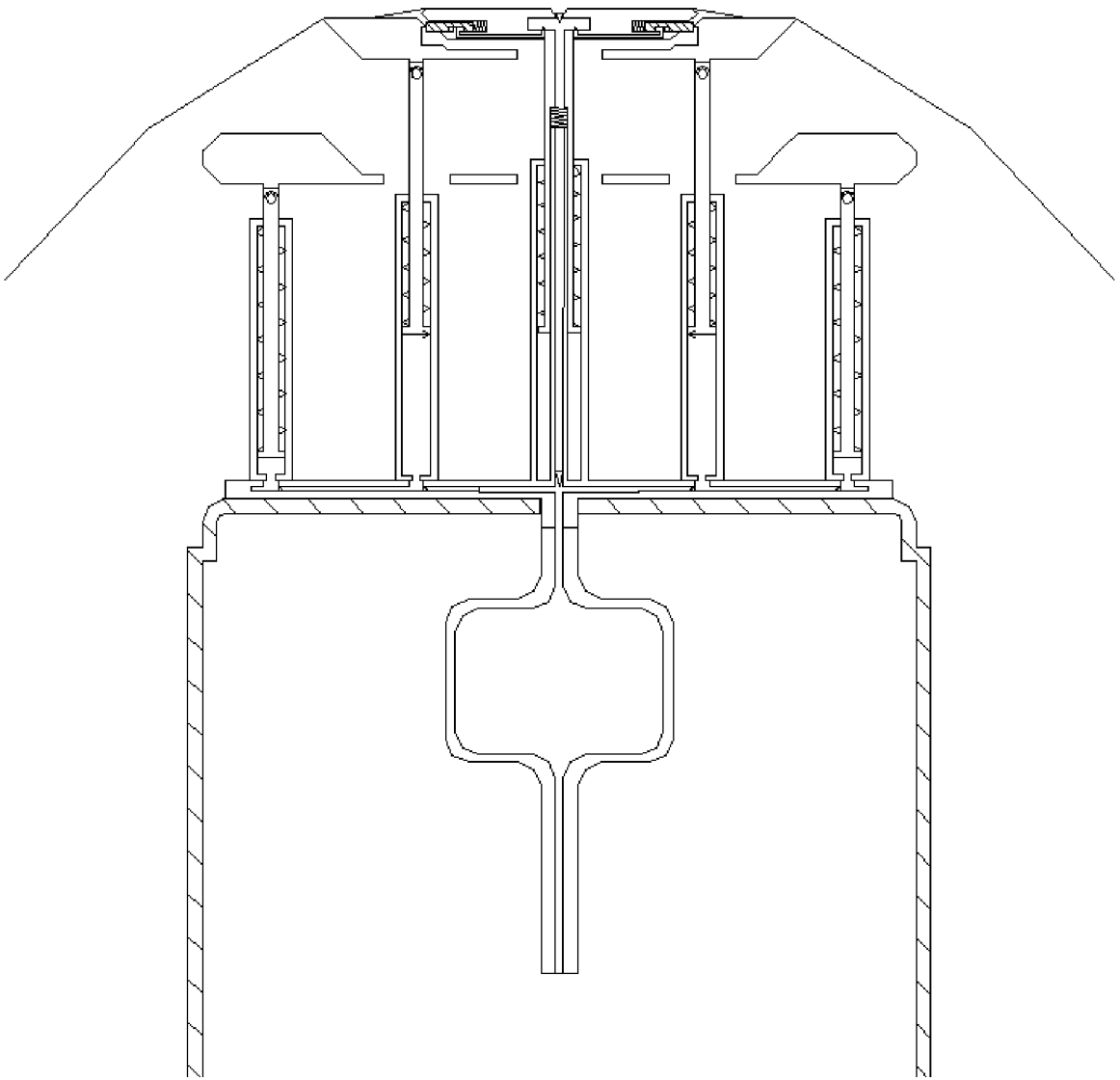
FIG. 17 is a separation schematic diagram of three cavitators after a combined disc-type cavitation structure for underwater navigation of an underwater vehicle enters water in an embodiment of the present invention.

In use condition: After being launched, the air-launched underwater vehicle 1 flies in the air, at this time, the parts installed at the head of the underwater vehicle 1 and located in the fairing 2 are protected and covered by the fairing 2. The first cavitator 3 and the two second cavitators 4 are arranged axially, and the outer edges thereof are in a stepped shape. When the underwater vehicle 1 is about to enter water, the blasting device inside the fairing 2 is first detonated, at a suitable height measured by a laser rangefinder, by the detonating device inside the underwater vehicle 1, so that the fairing 2 is divided into multiple pieces, at the same time, the de-energized electromagnet circumferentially disposed between the end of fairing 2 and the head of the underwater vehicle 1 is triggered to power off. Thus, the fairing 2 will be completely separated from the main underwater vehicle 1. After the fairing 2 is separated, the first ventilation valve 807 and the reverse jet valve 809 are opened, and the other valves are still closed, so that the gas in the gas storage tank 808 passes through the first gas path 806, the first vent tube 801, the buffer gas cavity 802, the through hole 804, the gas collection cavity 805 and then is jetted to the water surface from the jet port in the center of the first cavitator 3 to preform reverse jet deceleration and load reduction. Then, the first cavitator 3 touches water, at this time, the first ventilation valve 807 and the reverse jet valve 809 are closed, the first cavitator 3 is subjected to tremendous water impact pressure, the first piston rod 504 of the buffer 5 moves rightwards, the tension spring 506 is extended and the first compression spring is shortened, at the same time, the hydraulic oil in the buffer is extruded to the oil storage chamber 503. After the underwater vehicle 1 enters water, a supercavity is formed under the action of the cavitator 3. However, as the navigation speed of the underwater vehicle 1 decreases gradually, the size of the supercavity maintaining the navigation thereof at lower navigation resistance decreases, which is not conducive to supercavity navigation of the underwater vehicle. Meanwhile, the second cavitator 4 can be adjusted to combine with the first cavitator 1 to form a combined cavitator, so as to increase the supercavity diameter. The adjustment process is shown in FIGS. 13 to 16. The second ventilation valve 605 corresponding to the front-most second cavitator 4 is opened and the other valves are closed. The gas in the gas storage tank 808 enters the air cylinder 601 to push the second piston rod 602 to move leftwards, so that the second compression spring 606 is compressed and shortened, and the second piston rod 602 pushes the second cavitator 4 move leftwards to gradually close to the first cavitator 4 (as shown in FIG. 14). During the movement process of the head of the second cavitator 4, the wall of the cavitator receiving groove 401 thereof touches the slider 901 of the first cavitator 3, making it move inwards in a circumferential direction (the slider 901 originally extends in a circumferential direction under the action of the fixed pin compression spring 18 of the cavitator 1, as shown in FIG. 9). When the second cavitator 4 continues to move leftwards, the slider 901 will be inserted into the clamping slot 402 at some point, finally forming the state as shown in FIG. 15. The function of the slider 901 and the slot 402 is to fix the combination of the first cavitator 3 and the second cavitor 4 to form a larger cavitator disc face. At this time, under the action of the combined cavitator, the generated supercavity has a larger diameter, which is beneficial to maintain larger supercavity after the navigation speed of the underwater vehicle 1 is reduced, so as to maintain a lower navigation resistance. Similarly, the second ventilation valve 605 of the secondary second cavitator 4 can be opened as needed, so as to make the secondary second cavitator move leftwards like the front-most second cavitator 4 and combine with it to form a more larger supercavity (as shown in FIG. 16). The present invention can also adjust the combination and separation reset of the combined cavitator at any time according to the actual situation. As shown in FIG. 17, the secondary second cavitator 4 can discharge the gas in the gas cavity through the air release valve by means of closing the second ventilation valve 605, and the second compression spring 606 extends and resets to push the second piston rod 602 to move rightwards and reset, so that the second cavitator 4 moves rightwards to be separated from the combined cavitator, which is a process of reducing the diameter of the cavitator disc face and the diameter of the supercavity (as shown in FIG. 17).

Before separation between the first cavitator 3 and the front-most second cavitator 4, it is necessary to separate the slider 901 from the slot 402. Open the first ventilation valve 807 and the slider driving valve 906, so that the gas in the gas storage tank 808 enters the slider driving gas cavity to press the fixed pin compression spring 902, so as to make the slider 901 move into the sliding slot, thereby the slider 901 is separated from the slot 402.

The air cylinder 601 can be filled with some gas to serve as an air cushion, which can also be used as a buffer.

Finally, it should be stated that the above various embodiments are only used to illustrate the technical solutions of the present invention without limitation; and despite reference to the aforementioned embodiments to make a detailed description of the present invention, those of ordinary skilled in the art should understand: the described technical solutions in above various embodiments may be modified or the part of or all technical features may be equivalently substituted; while these modifications or substitutions do not make the essence of their corresponding technical solutions deviate from the scope of the technical solutions of the embodiments of the present invention.

The invention claimed is:

1. A combined disc-type cavitation structure for underwater navigation of an underwater vehicle, comprising a underwater vehicle with a front end thereof separably connected with a fairing disposed coaxially with the underwater vehicle, wherein a plurality of cavitators with successively increasing outer diameters are in turn arranged inside the fairing from a front end to a rear end of the fairing, the plurality of cavitators are arranged coaxially and axes thereof coincide with an axis of the underwater vehicle, a cavitator receiving groove, matching a cavitaor located at a front side in every two adjacent cavitators, is disposed at a center of a front surface of a cavitator located at a rear side in every two adjacent cavitators, and the plurality of cavitators are integrated into a whole through the cavitator receiving groove, a front-most cavitator is a first cavitator and all the cavitators behind the first cavitator are second cavitators, the first cavitator is connected to the underwater vehicle through a buffer configured to buffer an acting force between the underwater vehicle and water when the underwater vehicle enters the water, and each of the second cavitators is connected to the underwater vehicle through a driving device configured to axially move its corresponding second cavitator.

2. The combined disc-type cavitation structure for underwater navigation of an underwater vehicle according to claim 1, wherein the fairing comprises a cone section and a cylinder section, the cone section is located at a front end of the cylinder section, and a rear end of the cylinder section is connected to the underwater vehicle through a de-energized electromagnet disposed in the underwater vehicle, the fairing is composed of a plurality of split housings, and every two adjacent split housings are connected through a connection structure, a blasting device is disposed at the connection structure, a detonating device is disposed in the underwater vehicle for detonating the blasting device, and the fairing is separated along the connection structures between adjacent split housings after the detonating device detonates the blasting device.

3. The combined disc-type cavitation structure for underwater navigation of an underwater vehicle according to claim 1, wherein a front end of the first cavitator is provided with a blowback system for blowing gas forward.

4. The combined disc-type cavitation structure for underwater navigation of an underwater vehicle according to claim 3, wherein an output end of the buffer, passing through all the second cavitators, is fixedly connected to the first cavitator, and the output end of the buffer is in clearance fit with each the second cavitator, wherein the buffer comprises an outer sleeve, an inner sleeve is disposed in the outer sleeve, a part between the outer sleeve and the inner sleeve forms an oil storage cavity, a first piston rod is disposed in the inner sleeve, a front end of the first piston rod passes through the outer sleeve and the inner sleeve and is fixedly connected to the first cavitator, a first piston is disposed at a rear end of the first piston rod, a part between the first piston and a front end of the inner sleeve is provided with a tension spring sleeved on the first piston rod, a damper base is fixed at a head end of the underwater vehicle, and a rear end of the outer sleeve is fixedly connected to the damper base.

5. The combined disc-type cavitation structure for underwater navigation of an underwater vehicle according to claim 4, wherein the blowback system comprises a first vent tube, a front end of the first vent tube successively passes through a rear end center of the outer sleeve and a rear end center of the inner sleeve, and penetrates into the first piston rod and is in airtight sliding connection with an inner wall of the first piston rod, an inside of the first piston rod close to its front end is provided with a buffer gas cavity, a rear end of the buffer gas cavity is communicated with the front end of the first vent tube, the buffer gas cavity is internally provided with a first compression spring with an axis coinciding with an axis of the first piston rod, an end surface of the first vent tube abuts against the first compression spring, a front end of the first piston rod is provided with a through hole communicated with the buffer gas cavity, a front end of the through hole is communicated with an gas collection cavity disposed in the first cavitator; a first gas path is disposed in the damper base, a front end of the first gas path is communicated with a rear end of the first vent tube, a first ventilation valve is disposed in the first gas path, a gas storage tank is disposed in the underwater vehicle, a gas outlet of the gas storage tank is communicated with a rear end of the first gas path; and the front end of the first cavitator is provided with a jet port, and the jet port is provided with a reverse jet valve inside.

6. The combined disc-type cavitation structure for underwater navigation of an underwater vehicle according to claim 5, wherein at least one slider mechanism is disposed at an outer edge of the first cavitator, and the cavitator receiving groove of the second cavitator close to the first cavitator is provided with a slot matching the slider mechanism, wherein the slider mechanism comprises a slider and a slider driving mechanism that drives the slider to slide in a radial direction of the first cavitator, and when the first cavitator is located in the cavitator receiving groove, the slot seizes the slider.

7. The combined disc-type cavitation structure for underwater navigation of an underwater vehicle according to claim 6, wherein the outer edges of all the second cavitators, except the second cavitator at the rearmost end, and the outer edge of the first cavitator are oblique planes, wherein the slider driving mechanism comprises a sliding slot machined on a side wall of the first cavitator, the slider is in sliding fit with the sliding slot, a bottom of the slider and a bottom of the sliding slot are connected with a fixed pin compression spring, a limiting stop is disposed on a wall of the sliding slot, a limiting slot is machined on a side of the slider facing the limiting stop, the limiting stop is located in the limiting slot, a slider driving gas cavity is formed among a lower side of the limiting stop, the limiting slot and the wall of the sliding slot, one end of a second vent tube is communicated with the gas collection cavity through a slider driving air valve, the other end of the second vent tube radially penetrates into the first cavitator and penetrates out of the slider driving gas cavity.

8. The combined disc-type cavitation structure for underwater navigation of an underwater vehicle according to claim 7, wherein the driving device comprises a plurality of pneumatic driving devices which are evenly distributed around an axis of the second cavitators, and an axis of each pneumatic driving device is parallel to the axis of the second cavitator, an output end of each pneumatic driving device is hinged with the second cavitatior and a hinge point thereof is close to an outer edge of the second cavitator, an output end of each pneumatic driving device hinged with the second cavitator located in front passes through all of the second cavitators located behind this second cavitator and is in clearance fit with the same, and a mounting end of each pneumatic driving device is fixedly connected to the damper base.

9. The combined disc-type cavitation structure for underwater navigation of an underwater vehicle according to claim 8, wherein each the pneumatic driving device comprises an air cylinder, a second piston rod matching the air cylinder is disposed in the air cylinder, a front end of the second piston rod penetrates out of the air cylinder and is hinged with the second cavitator, a second piston is fixed at a rear end of the second piston rod, a part between a front end of the air cylinder and the second piston is provided with a second compression spring sleeved on the second piston rod; and the damper base is provided with a second gas path inside, one end of the second gas path is communicated with the gas storage tank, the other end of the second gas path is communicated with a rear end of the air cylinder, the second gas path is provided with a second ventilation valve, and the rear end of the air cylinder is provided with an air release valve.

* * * * *